US005671987A

United States Patent [19]

Hommes

[11] Patent Number: 5,671,987

[45] Date of Patent: Sep. 30, 1997

[54] RETRACTABLE SPICE BIN

[76] Inventor: Gerry G. Hommes, 18535 Brymer St., Northridge, Calif. 91326

[21] Appl. No.: 502,644

[22] Filed: Jul. 14, 1995

[51] Int. Cl.[6] ..... A47B 88/00

[52] U.S. Cl. ..... 312/334.23; 312/234.5; 312/348.6

[58] Field of Search ..... 312/334.23, 334.24, 312/334.27, 334.28, 334.44, 287, 309, 310, 249.1, 330.1, 245, 234.5, 348.6; 211/94, 94.5, 74; 384/18, 20, 21, 23

[56] References Cited

U.S. PATENT DOCUMENTS

| | | | |
|---|---|---|---|
| 637,361 | 11/1899 | Suters | 312/334.23 X |
| 827,649 | 7/1906 | Murphy | 211/74 X |
| 842,780 | 1/1907 | Gardner | 312/310 X |
| 850,649 | 4/1907 | Huntington | 312/334.44 X |
| 1,414,505 | 5/1922 | Ede | 312/334.44 X |
| 2,327,761 | 8/1943 | Brodbeck | 312/334.15 |
| 2,950,158 | 8/1960 | Harmon | 312/334.14 |
| 2,987,364 | 6/1961 | Fall | 312/334.8 |
| 3,452,878 | 7/1969 | Smith | 312/334.23 X |
| 3,874,756 | 4/1975 | Greene | 312/334.24 X |
| 4,072,375 | 2/1978 | Boone | 312/334.8 |
| 4,375,306 | 3/1983 | Linder | 312/201 X |
| 4,653,818 | 3/1987 | DeBruyn | 312/350 X |

FOREIGN PATENT DOCUMENTS

| | | | |
|---|---|---|---|
| 582775 | 2/1994 | European Pat. Off. | 312/334.28 |
| 1370881 | 10/1974 | United Kingdom | 312/257.1 |

*Primary Examiner*—Peter M. Cuomo
*Assistant Examiner*—Janet M. Wilkens
*Attorney, Agent, or Firm*—Albert O. Cota

[57] ABSTRACT

A retractable spice bin (10) that is designed and dimensioned to be retractably attached to a cabinet such as a kitchen cabinet (105). The bin (10) has a rectangular shape with six side panels. One of the vertical side panels (44) has an open area (50) that allows access into the bin (10). The bin is dimensioned to allow a set of round containers (162) such as spice jars, square containers (164) or a combination of both to be contained within the bin (10). The bin includes a retractable slide assembly (70) that includes an upper way (72) that is longitudinally attached to the lower surface (154) of a kitchen cabinet (156) and a lower way that is longitudinally attached to the upper surface (16) of the bin's upper panel (14). Between the two ways, is a captive gib (108) dimensioned to traverse through the upper and lower ways. The retractable slide assembly (70) allows the bin to be retracted inward for storage and extended outward to allow a container to be removed from or returned to the retractable spice bin (10).

2 Claims, 4 Drawing Sheets

RETRACTABLE SPICE BIN

TECHNICAL FIELD

The invention pertains to the general field of storage bins and more particularly to a storage bin that is retractably attached to an upper surface of a kitchen cabinet and that is dimensioned to store a plurality of small containers.

BACKGROUND ART

Modern household kitchens are designed to include an assortment of kitchen cabinets that generally have a pair of cabinet doors. These cabinets are dimensioned to store a myriad of kitchen articles and utensils such as dishes, cups, various types and sizes of containers, non-refrigerated food and the like.

Most household cooks utilize spices when preparing a meal and these spices are often contained in small round and square containers. Because of their relative small size and the assortment of spices available, many such spice containers are purchased and conveniently stored for later use in the cabinets. If these spice containers are not visibly stored, a disarray is created and a particular spice may be difficult to find and more often then not, the particular spice may be lost forever in the void of the cabinet.

The prior art has endeavored to solve the problem of lost and/or misplaced spice containers by providing spice racks and "lazy susan" type rotating assemblies. The spice racks are either hung on a wall or placed upon a flat surface and the rotating assemblies are usually placed inside a cabinet. The rotating assemblies require the use of a large portion of the cabinet space and because of its round shape, much of the cabinet's corner space is not usable because of its inaccessibility.

A search of the prior art did not disclose any patents that read directly on the claims of the instant invention. However, the following U.S. patents are considered related:

| PATENT NO. | INVENTOR | ISSUED |
|---|---|---|
| 5,131,732 | Lane et al | 21 July 1972 |
| 2,812,067 | Gussack | 5 November 1957 |
| 2,742,161 | Nuttall | 17 April 1956 |

The 5,131,732 Lane et al patent discloses a storage cabinet system. The system includes a file cabinet consisting of at least one compartment having a plurality of individual slidable storage units. Each storage unit has a pocket for retaining a series of documents. When the storage unit is pulled outward from the file cabinet housing, the retained documents remain neatly organized and readily accessible. Each storage unit includes a slanted wall on which the documents are supported, a retaining arm for maintaining the documents fixed in the pocket, and an assembly which allows movement of the unit.

The 2,812,067 Gussack patent discloses a pivot slide which can be attached to a horizontal member. When attached, the slide permits the hanging and storage of articles, such as samples, permitting such articles to be pulled outwardly for viewing. Thus, allowing a salesperson to easily pull out the sample i.e., a rug, that is to be displayed and then swing the rug around to any desired position for further examination by a customer.

The 2,742,161 Nuttall patent discloses a sorting rack that is specifically designed for sorting mail. The rack consists of elemental cell units arranged so that they can easily and quickly be grouped and connected to form a rack. The rack design allows a wide variety of shapes and sizes of racks to be constructed using the same essential components. The rack cells are arranged so that the material placed therein is in the most convenient position for grasping and inspection.

For background purposes and as indicative of the art to which the invention relates reference may be made to the following remaining U.S. patents found in the search.

| PATENT NO. | INVENTOR | ISSUED |
|---|---|---|
| 5,160,051 | Bustos | 3 November 1992 |
| Des. 254,887 | Jorda-Segui | 6 May 1980 |
| 3,851,937 | Winston | 3 December 1974 |

DISCLOSURE OF THE INVENTION

The retractable cabinet rack is specifically designed to solve the problem of visably storing and retrieving small containers such as spice jars. In its basic form, the retractable spice bin has six sides that include an upper panel and a vertical side panel having an open area. The open area permits access into the bin to allow at least one spice jar to be stored therein and subsequently retrieved.

The rack is designed to be attached to an upper, horizontal mounting structure as located on a cabinet that preferably consists of a kitchen cabinet. The attachment is made by means of a bin retracting assembly that is attached between the cabinet's upper surface and the bin's upper panel. The retracting assembly allows the retractable spice bin to be retracted inward into the cabinet for storage of the containers and extended outward from the cabinet. When the spice bin is in its outward position a spice jar can be easily inserted into and removed from the open area of the bin.

The dimensions of the bin allow it to fit into and be easily attached to a kitchen cabinet having a standard depth of eleven inches. The width of the bin also permits several of the bins to be attached in a side-by-side configuration. The bin's dimensions also permits several sizes and shapes of containers, such as round and square containers, to be retained within the bin.

To allow the bin to be easily pulled outward to its extended position, a handle is located on the front and back panel of the bin. A handle is located on each panel so that the bin can be installed with either a right facing open area or a left-facing open area. On the front panel of the bin can also be attached a transparent plastic pocket into which is inserted a strip that lists and identifies the contents of the particular bin. Since each bin slides independently of each other and each bin is identified, the invention provides an organized method for the storage and retrieval of small containers.

In view of the above disclosure, it is the primary object of the retractable spice bin to allow it to be easily attached to the upper surface of a kitchen cabinet or the like, and to house a set of containers that are stored when the bin is retracted into the cabinet and that are very accessible for removable when the bin is extended from the cabinet.

In addition to the primary object of the invention, it is also an object to produce a retractable cabinet rack that:

maximizes the orderly use of space in a cabinet;

requires a minimum amount of assembly skill to install the bin, can be easily removed from the bin retracting assembly and placed in another location or group, can be manufactured in various sizes using the same design features, has internal dimensions that minimizes the tipping of a container when the storage area is not filled, can be manufactured in various color schemes and finishes, is maintenance free, and is cost effective from both a manufacturers and consumer points of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred embodiment for a retractable spice bin 10 that is designed to hold a plurality of small containers such as spice jars 160. The preferred embodiment as shown in FIGS. 1–13, is comprised of two major elements: a six-sided bin 12 and a bin retracting assembly 70.

The six-sided bin 12 is preferably molded of a plastic material. However, the bin can also be constructed of individual wood or plastic panels joined together by some means, such as detent pairs and/or an adhesive.

Figure 1:
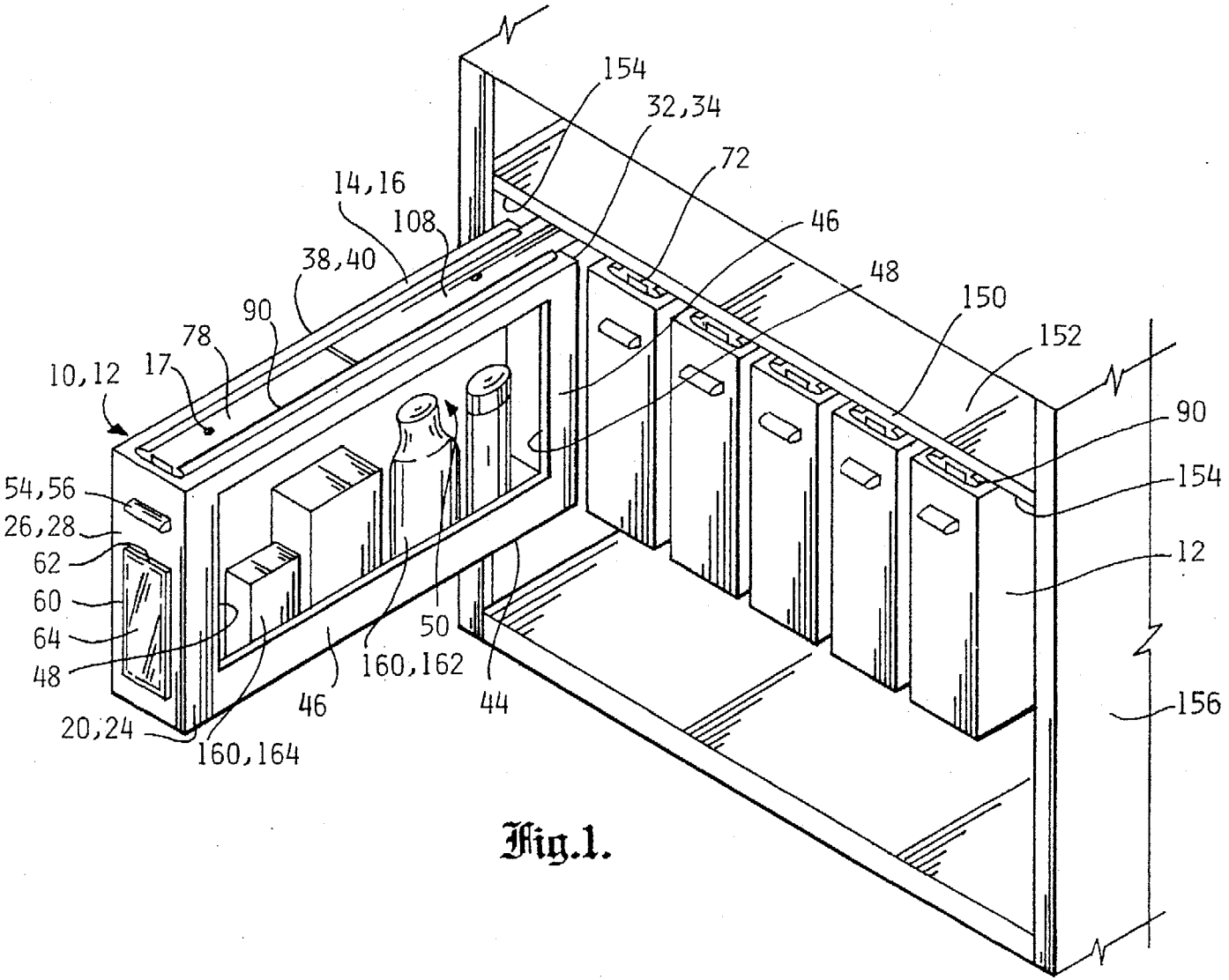
FIG. 1 is a perspective view of cabinet, such as a kitchen cabinet, having installed a set of six retractable spice bins with one of the bins shown in its extended position.
Figure 3:
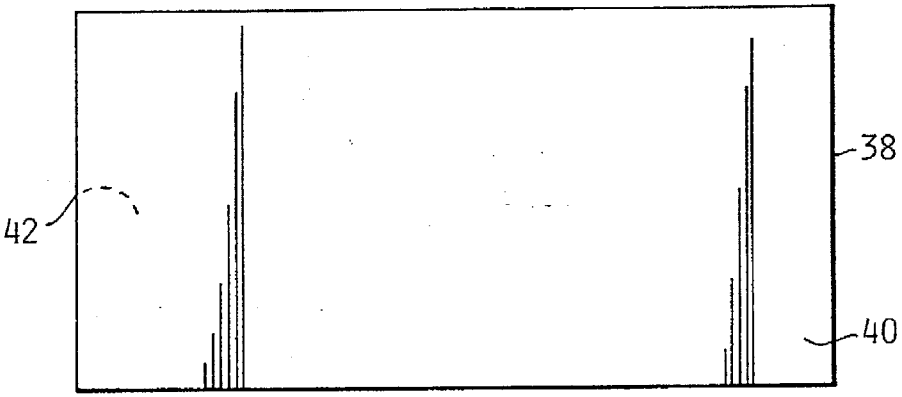
FIG. 3 is a side elevational view of the bin's first vertical side panel
Figure 5:
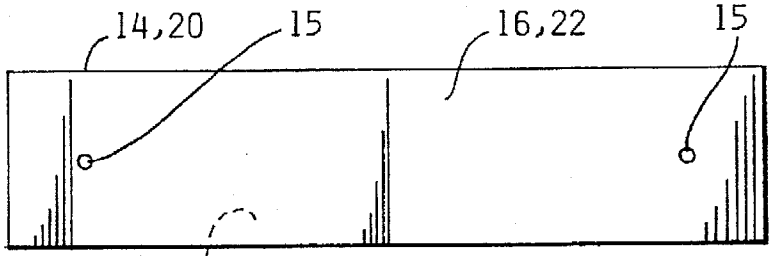
FIG. 5 is a top top plan view of the bin's upper and lower panels.

In either construction method, the retractable cabinet bin 10 as shown in FIG. 1, consists of six panels. The bin is preferably made in a rectangular shape and is integrally formed with an upper panel 14 having an upper surface 16, a lower surface 18 and a pair of mounting bores 15; a lower panel 20 having an upper surface 22 and a lower surface 24; a front panel 26 having an outer surface 28 and an inner surface 30; a rear panel 32 having an outer surface 34 and an inner surface 36; a first vertical side panel 38 having an outer surface 40 and an inner surface 42; and a second vertical side panel 44.

Figure 2:
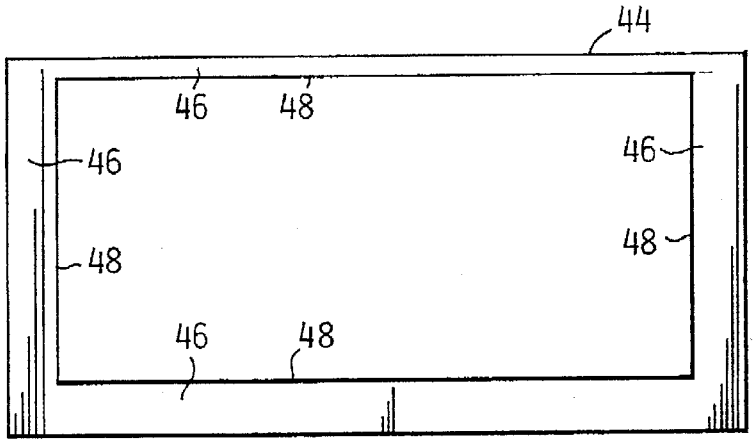
FIG. 2 is a side elevational view of the bin's second side panel having inward protruding sections further having outward edges which define an open area that allow access into the bin

The second vertical side panel 44 as shown in FIGS. 1 and 2 has a rectangular cutout 50 surrounded by a framed perimeter border 46 with inwardly facing cutout edges 48 defining an open area 50 that permits access into the rack and allows an assortment of containers 160 such as spice jars to be inserted therein and removed therefrom when needed.

Figure 7:
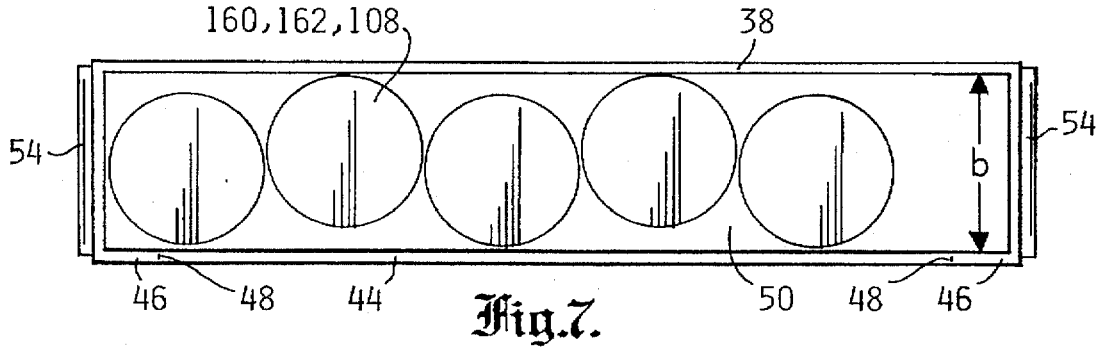
FIG. 7 is a top plan view showing five round containers having larger diameters stored in the rack.
Figure 8:
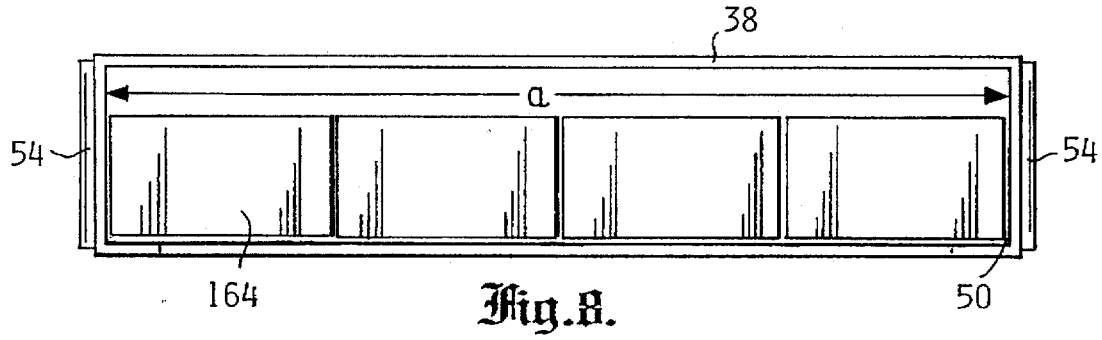
FIG. 8 is a top plan view showing four square containers stored in the bin.

The retractable spice bin 10 can be manufactured in a multitude of dimensions that include an inside length "a" and an inside width "b" as shown in FIGS. 7 and 8. The inside length "a" is preferably 10.125 inches (25.72 cm) and the inside width "b" is 2.0 inches (5.08 cm). These dimensions allow the retractable spice bin 10 to accommodate a plurality of round containers 162, square containers 164 or a combination of both round and square containers. For example, in FIG. 6, seven 1.5 inch (3.81 cm) diameter containers 162, such as spice jars, are accommodated. In FIG. 7, five 1.75 inch (4.45 cm) diameter containers 162 are accommodated. In FIG. 8, four 1.5 inch by 2.5 inch (3.81 by 6.35 cm) square containers 164 can be fitted into the bin 10 and in FIG. 9, three 1.75 by 2.875 inches (4.45 by 18.55 cm) square containers 164 are stored.

To further enhance the utility of the retractable cabinet bin 10, a handle 54, a transparent plastic pocket 60, and/or a container stop 66 can be added.

Figure 4:
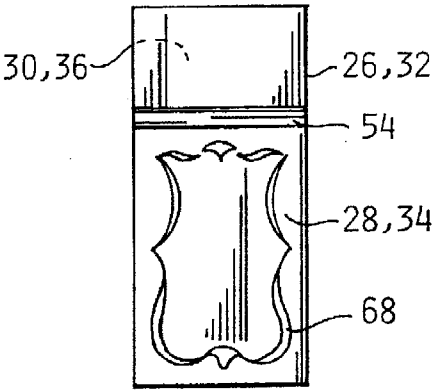
FIG. 4 is an elevational end view of the bin's front and rear panels.
Figure 6:
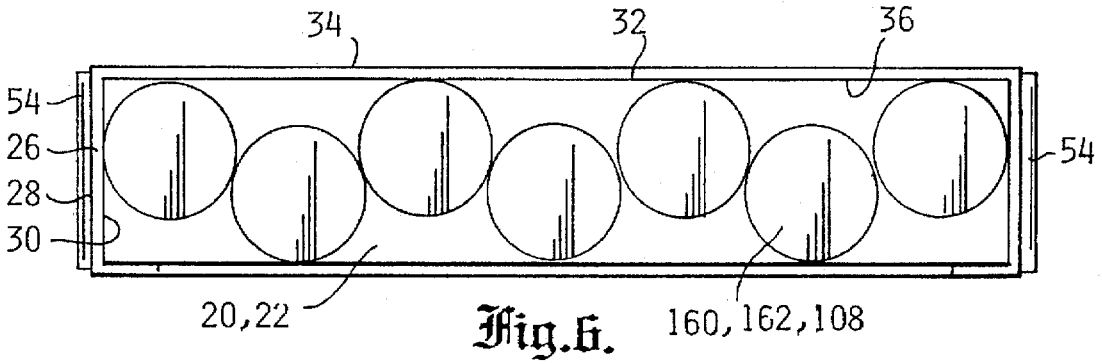
FIG. 6 is a top plan view showing six round containers stored in the bin.
Figure 14:
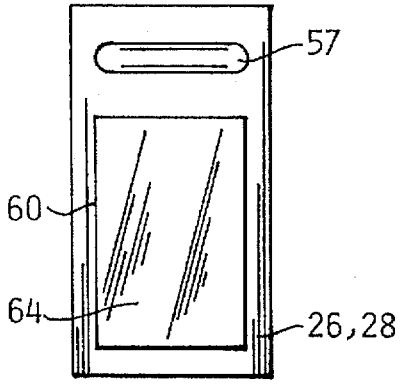
FIG. 14 is an elevational end view of the bin's front and rear panels illustrating the recessed gripping section embodiment.

The handle 54, as shown in FIGS. 1 and 4 is located on both the front panel 26 and the rear panel 32. By having a handle 54 on both sections, the bin can be attached with a left opening 50 as shown in FIG. 1, or the bin can be rotated 180-degrees and attached to have a right opening 50 (not shown). The handle preferably consists of a molded elongated block 56. However, in lieu of the block 56, a recessed gripping section 57 shown in FIG. 14 may be cut into the panels 26, 32.

Depending on whether a right or left opening is desired, the bin 10 includes a means for identifying the contents of particular bin 10. This identification can be accomplished by attaching, by an attachment means, to either the front or back panels 26,32 as shown in FIG. 1, the transparent plastic pocket 60, that includes an upward opening 62. Into the opening 62 is then inserted a strip 64 of material that includes indicia indicating the contents of the bin 10. In lieu of the pocket 60 and strip 64, a strip of material having a surface suitable for marking with a pen or pencil can be attached to the front panel.

Figure 9:
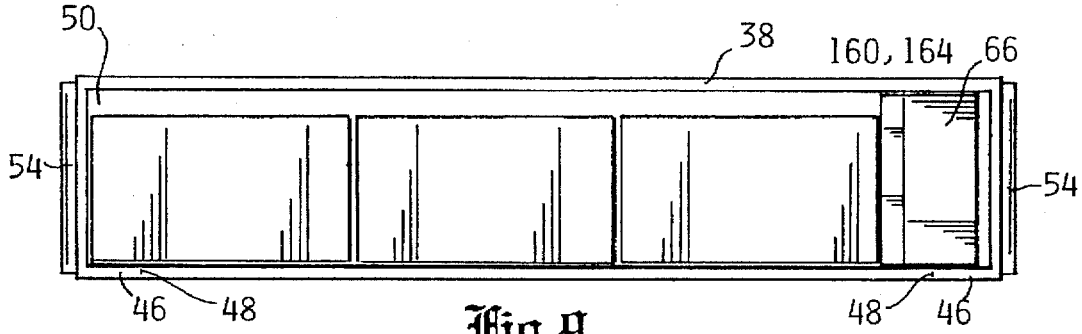
FIG. 9 is a top plan view showing three larger square containers stored in the bin.

The final enhancement disclosed, is the container stop 66 as shown in plan view in FIG. 9. The stop 66 has the appearance of a conventional "book end" with a vertical section that is integrally attached to a horizontal section. The vertical section interfaces with the side of a spice jar container 160 and the horizontal section with the upper surface 22 of the lower panel 20. The stop has a width that allows the stop 66 to frictionally slide along the lower panel 20 and is intended to be used only when one or two containers 160 are stored in the bin 10.

To add to the aesthetics of the retractable spice bin 10, the front and rear panels 26,32 of the bin can be embellished.

The embellishment can consists of an etched section 68 as shown in FIG. 4, or the front panel can be painted in a complimentary of contrasting color from that of the kitchen cabinets or other mounting cabinet.

The bin retracting assembly 70 comprises the second major element of the retractable spice bin 10. The assembly 70 is designed to be longitudinally attached between the lower surface 154 of an upper horizontal mounting structure 150 and the upper surface 16 of the upper panel 14. The retractable assembly 70 allows the bin 10 to be retracted inward for storage as shown in FIG. 1, or to be extended outward to permit access into the bin's open area 50 as also shown in FIG. 1.

Figure 10:
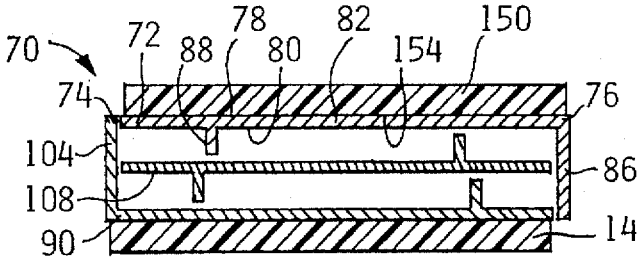
FIG. 10 is a side functional/sectional view of the retractable slide assembly when the bin is in a fully retracted position.
Figure 11:
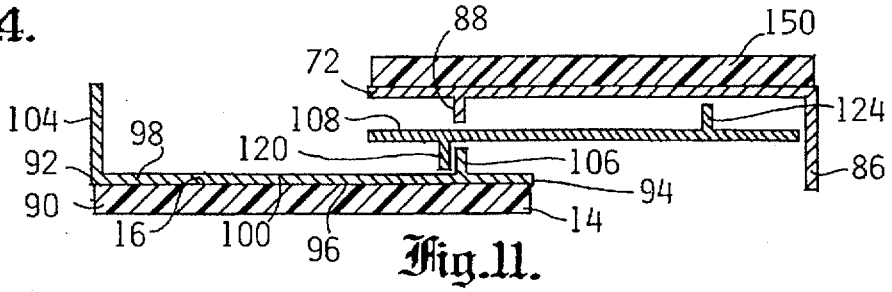
FIG. 11 is a side functional/sectional vie of the retractable slide assembly when the bin is partially extended.
Figure 12:
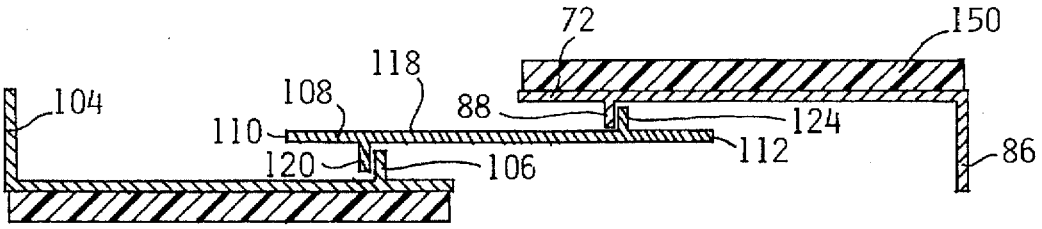
FIG. 12 is a side functional/sectional view of the retractable slide assembly when the bin is in its fully extended position.

The preferred embodiment of the retractable slide assembly 70 consists of three basic elements: an upper way 72, a lower way 90 and a captive gib 108. The assembly 70 as would be configured when the bin 10 is fully retracted as shown in FIG. 10; when the bin 10 is partially extended is shown in FIG. 11; and the bin in its fully extended position is shown in FIG. 12. The assembly 70 fully assembled with the gib 108 inserted into both the upper and lower ways 72,90 is shown in a front elevational view in FIG. 13.

The upper way 72 as shown in FIG. 10, includes a front edge 74, a rear edge 76, an upper surface 78 and a lower surface 80. The upper surface 78 is rigidly and longitudinally attached to the lower surface 154 of the upper horizontal mounting structure 150 which preferably consists of a lower surface 154 of a kitchen cabinet 156 as shown in FIG. 1. The preferred attachment means, which is well known in the art and therefore not shown, consists of drilling two holes 15 through the upper way 72 and threading a screw into the upper surface 152.

Figure 13:
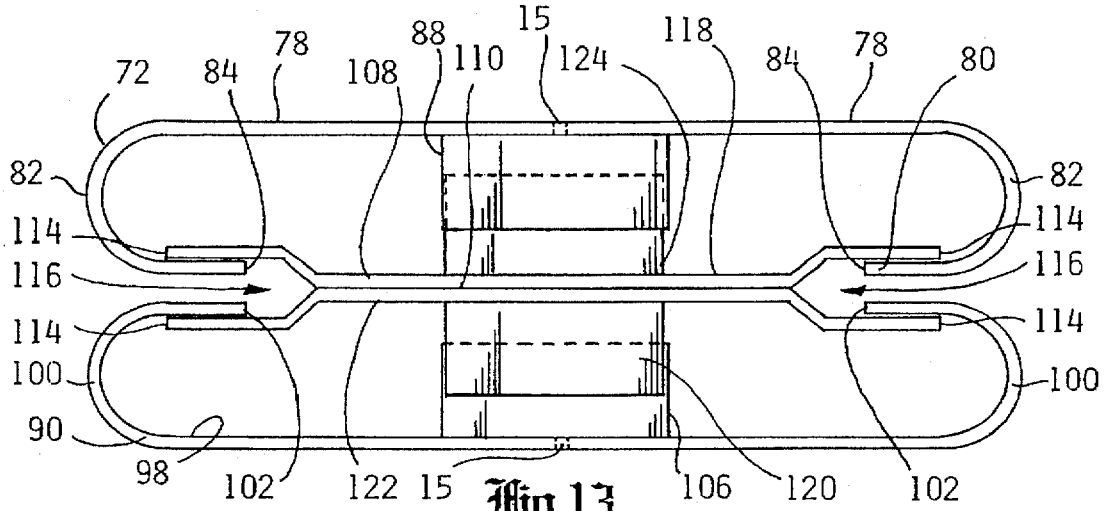
FIG. 13 is an elevational front view showing the interface between the gib and upper and lower ways. For clarity, the front stop and rear stop is not shown.

The lower surface 80 of the upper way 72 has sides 82 as best shown in FIG. 13. Each side curves inward and terminates with a longitudinal edge 84 that is substantially parallel with the upper surface 78. The upper way also includes a rear stop 86 and a first stop 88. The rear stop 86 extends downward from the rear edge 76 and the first stop extends downward and is located inward from the front edge 74.

The lower way 90 is structurally identical to the upper way 72 and also includes as shown in FIG. 11, a front edge 92, a rear edge 94, a lower surface 96, and an upper surface 98. The lower surface 96 is rigidly and longitudinally attached to the upper surface 16 of the upper panel 14 as shown in FIG. 1. The preferred attachment means consists of drilling two holes 15 through the upper panel 14 which are in alignment with two holes 15 in the lower way 90. Through these hole pairs is then attached a bolt and nut combination or screws 17 as are well known in the art.

The upper surface 98 has sides 100 as also shown in FIG. 13. Each side curves inward and terminates with a longitudinal edge 102 that is substantially parallel with the lower surface 96. The lower way 90 also includes a front stop 104 and a fourth stop 106. The front stop extends upward from the front edge 92 and the fourth stop extends upward and is located inward from the rear edge 94.

The captive gib 108 is shown in a front and rear elevational view in FIG. 13. A can be seen in FIG. 13, the gib is constructed of metal of two identical pieces that when attached together, such as by a spot welding method, form a gib 108. The assembled gib includes as shown in FIG. 12, a front edge 110, a rear edge 112, side edges 114, an upper surface 118 and a lower surface 122.

The two side edges 114 of the assembled gib form a longitudinal channel 116 as shown in FIG. 13. The channel is sized to slidably traverse through the respective longitudinal edges 84, 102 of the upper and lower ways respectfully. The lower surface 122 has a second stop 120 that extends downward and that is located inward from the front edge 110. The upper surface 118 has a third stop 124 that extends upward and that is located inward from the rear edge 112. The stops are shown in side views in FIGS. 10, 11 and 12, and in a front elevational view in FIG. 13.

When the bin 10 is fully retracted as shown in FIG. 10, the front edge 74 of the upper way 72 and the front edge 110 of the gib 108 interface with the front stop 104 of the lower way 90. Likewise, the rear edge 94 of the lower way 90 and the rear edge 112 of the gib 108 interface with the rear stop 86 of the upper way 72. To extend the bin 10, the handle 54 is grasped and pulled partially outward as shown in FIG. 11. This step allows the fourth stop 106 on the lower way 90 to interface with the second stop 120 on the gib 108. The outward bin movement is continued until the third stop 124 on the gib 108 interfaces with the first stop 88 on the upper way 72. To extend the rack 10, it is pulled partially outward by the handle 54 as shown in FIG. 12. When so pulled, the fourth stop 106 on the lower way 90 interfaces with the second stop 120 on the gib 108. The outward bin movement is continued until the third stop 124 on the gib 108 interfaces with the first stop 88 on the upper way 72 at which event the bin is fully extended as shown in FIG. 12. In this fully retracted configuration, containers 106 can be removed from or added to the bin 10.

The retractable spice bin 10 as shown in FIG. 1 is designed to be attached via the bin retracting assembly 70, to the lower surface 104 of an upper, horizontal mounting structure 100 as found in most kitchen cabinets 105. More specifically, the bin is dimensioned to be attached to a kitchen cabinet 105 having an inside depth of 11-inches (27.54 cm) and an inside height of at least 6-inches (15.24 cm). As also shown in FIG. 1, the outside width dimensions of the bin, allow several bins 10 to be attached side-by-side to provide a convenient and orderly way to store and use various types of food condiments such as spices.

While the invention has been described in complete detail and pictorially shown in the accompanying drawings it is not to be limited to such details, since many changes and modifications may be made to the invention without departing from the spirit and the scope thereof. For example, although the primary use of the bin 10 is for the storage of spices and the like, small implements such as screws, bolts, eyelets etc. can be stored and the bin attached to the bottom surface of a work bench. Also, with very little modification, the bin 10 can be made to be extended and retracted from either side of a central mounting surface. Hence, it is described to cover any and all modifications and forms which may come within the language and scope of the claims.

I claim:

1. A retractable spice bin comprising:

a) a kitchen cabinet that includes an upper, horizontal mounting structure having an upper surface and a lower surface, b) a six sided bin having a rectangular shape and integrally having:

(1) a solid upper panel having an upper surface and a lower surface, (2) a solid lower panel having an upper surface and a lower surface, (3) a solid front panel having an outer surface, an inner surface, and a handle, (4) a solid rear panel having an outer surface, an inner surface and a handle, (5) a solid first vertical side panel having an outer surface and an inner surface, wherein said first vertical side panel prevents any spice container from falling out during the insertion into or retrieval from said spice bin or when said spice bin is being pulled out from the cabinet or being pushed into the cabinet, (6) a second vertical side panel having a cutout therein, wherein said cutout defines an open rectangular area that permits said spice containers to be inserted and maintained therein and removed therefrom, and c) a retractable slide assembly comprising:

(1) an upper way longitudinally attached to the lower surface of said horizontal mounting structure, (2) a lower way longitudinally attached to the upper surface of said upper panel in alignment with said upper way, and (3) a captive gib dimensioned to traverse through said upper and lower ways, where said retractable slide assembly allows said bin to be retracted inward for storage and extended outward to allow access into said bin through the open rectangular open area on said second vertical side panel.

2. The spice bin as specified in claim 1 wherein the outside width dimension of said spice bin allows a plurality of spice bins to be placed side-by-side within said kitchen cabinet.

* * * * *